United States Patent [19]

Suzuki et al.

[11] Patent Number: 4,998,457

[45] Date of Patent: Mar. 12, 1991

[54] HANDHELD MUSICAL TONE CONTROLLER

[75] Inventors: Hideo Suzuki; Shunichi Matsushima; Masahiko Obata; Masao Sakama, all of Hamamatsu, Japan

[73] Assignee: Yamaha Corporation, Hamamatsu, Japan

[21] Appl. No.: 289,330

[22] Filed: Dec. 22, 1988

[30] Foreign Application Priority Data

Dec. 24, 1987 [JP] Japan ..... 62-328068
Dec. 24, 1987 [JP] Japan ..... 62-328069
Dec. 24, 1987 [JP] Japan ..... 62-196199

[51] Int. Cl.[5] ..... G10H 1/34; G10H 1/46

[52] U.S. Cl. ..... 84/600; 84/633; 84/644; 84/DIG. 7; 341/27; 341/34

[58] Field of Search ..... 84/1.01, 1.04–1.28, 84/DIG. 7, DIG. 30, 626, 600, 658, 633, 644, 665, 687–690, 719, 720, 744, 745; 128/774, 782; 273/183 R, 183 B, 186 R, 186 A, 186 B, 189 R; 341/34, 27

[56] References Cited

U.S. PATENT DOCUMENTS 3,270,119 8/1966 Griffith ..... 84/692
3,935,669 2/1976 Potrzuski et al. .
4,241,636 12/1980 Long .
4,245,539 1/1981 Jones .
4,301,704 11/1981 Nagai et al. .
4,528,885 7/1985 Chihana ..... 84/1.1
4,557,275 12/1985 Dempsey ..... 128/782
4,558,623 12/1985 Buchla ..... 84/1.1
4,658,690 4/1987 Aitken et al. ..... 84/DIG. 30
4,662,260 5/1987 Rumsey ..... 84/DIG. 7
4,667,685 5/1987 Fine ..... 128/782
4,794,838 1/1989 Corrigau ..... 84/1.1 X

FOREIGN PATENT DOCUMENTS 2224061 10/1974 France .

*Primary Examiner*—Stanley J. Witkowski
*Attorney, Agent, or Firm*—Spensley Horn Jubas & Lubitz

[57] ABSTRACT

A musical tone control apparatus includes at least one grip device having the shape which can be held by player's hand. This grip device further includes plural push switches each having a piezoelectric element whose resistance is varied in response to depressing pressure applied thereto. Based on a combination of depressed push switches and its depressing pressures, an externally provided musical tone generating apparatus is controlled such that tone pitch, tone color, tone volume, touch response or the like of musical tone will be controlled. In addition, an angle detector for detecting a swing movement of a player's arm can be further provided. Thus, the detected swing movement of the player's arm can be additionally used for controlling the musical tone.

10 Claims, 9 Drawing Sheets

| DIRECTION OF ARM | | ON SWITCH | | | | MUSICAL SCALE |
|---|---|---|---|---|---|---|
| LEFT | RIGHT | La | Lb | Ra | Rb | |
| UPPER | UPPER | ○ | ○ | ○ | ○ | $C^n$ |
| UPPER | MIDDLE | ○ | ○ | ○ | × | $D^n$ |
| UPPER | LOWER | ○ | ○ | × | × | $E^n$ |
| MIDDLE | UPPER | ○ | × | ○ | ○ | $F^n$ |
| MIDDLE | MIDDLE | ○ | × | ○ | × | $G^n$ |
| MIDDLE | LOWER | ○ | × | × | × | $A^n$ |
| LOWER | UPPER | × | × | ○ | ○ | $B^n$ |
| LOWER | MIDDLE | × | × | ○ | × | $C^{n+1}$ |
| LOWER | LOWER | × | × | × | × | $D^{n+1}$ |

○: ON X: OFF

HANDHELD MUSICAL TONE CONTROLLER

BACKGROUND OF THE INVENTION

1. Field of the Invention

The present invention relates to a musical tone control apparatus, and more particularly to a musical tone control apparatus which controls a musical tone generating apparatus to thereby generate a musical tone in response to a movement of player's hand, fingers or the like.

2. Prior Art

Conventionally, the music is performed by operating a keyboard and some switches in an electronic musical instrument, for example. However, in order to perform such electronic musical instrument, the player's movement must be always restricted, and it is impossible to perform the music with dancing. Meanwhile, the present applicant has proposed the musical tone control apparatus capable of controlling the musical tone based on the movement of player in U.S. patent application Ser. No. 108,205 filed Oct. 13, 1987. Such musical tone control apparatus can be played with dancing. However, this proposed musical tone control apparatus can not control the musical tone delicately.

Meanwhile, another known electronic keyboard musical instrument detects the initial-touch and after-touch of keys to thereby vary the musical tone. Herein, the initial-touch is the touch response corresponding to the varying speed in depth or force of each key depression at the instant when the key is depressed. The after-touch is the touch response corresponding to the continuous variation degree of depressing pressure of each key in a period when the key is continuously depressed. As the method of detecting the initial-touch, each key provides a break contact which is "on" when the key is not depressed and a make contact which is "on" when the key is depressed. In this case, by counting the time interval between a first time when the key is depressed so that the break contact is off and a second time when the make contact is on, it is possible to obtain an initial-touch signal corresponding to the varying speed of depressing pressure at the instant when the key is depressed. As the method of detecting the after-touch, a pressure sensor for detecting the depressing pressure of key is provided. In this case, it is possible to obtain an after-touch signal corresponding to the continuous variation of depressing pressure based on the output of this pressure sensor.

In order to detect the initial-touch in the conventional electronic keyboard musical instrument, each key must provide all of the break contact, make contact and counting circuit for measuring the time. Further, in order to detect the after-touch, each key must provide the pressure sensor additionally. Since the initial-touch and after-touch are detected by the different detecting means independently, the constitution of electronic keyboard musical instrument must be complicated. Further, since the key provides some contacts, there is a problem in that chattering might occur.

SUMMARY OF THE INVENTION

It is therefore a primary object of the present invention to provide a musical tone control apparatus which can be performed by freely moving a player's hands or feet.

In a first aspect of the invention, there is provided a musical tone control apparatus comprising:

(a) detecting means having a shape which can be held by one hand, the detecting means outputting a detection signal corresponding to depressing pressure applied thereto by corresponding finger when the detecting means is held by hand; and (b) musical tone control means for outputting musical tone control data based on the detection signal outputted from the detecting means, the musical tone control data controlling a musical tone generating apparatus, the musical tone generating apparatus being externally provided in order to generate a musical tone which is controlled in response to the depressing pressure of corresponding finger.

In a second aspect of the invention, there is provided a musical tone control apparatus comprising:

(a) pressure detecting means for outputting a detection signal corresponding to depressing pressure applied to each key in a keyboard or depressing pressure of each operation button;

(b) timing generating means for generating a timing signal when a predetermined time is passed after value of the detection signal exceeds over a reference value; and (c) storing means for inputting and storing the detection signal at every time when the timing signal is supplied thereto, the storing means outputting its stored data as a first signal corresponding to an initial-touch of each key, the detection signal being outputted as a second signal corresponding to an after-touch of each key.

In a third aspect of the invention, there is provided a musical tone control apparatus comprising:

(a) pressure detecting means having a shape which can be held by one hand, the detecting means outputting a detection signal corresponding to depressing pressure applied thereto by corresponding finger when the detecting means is held by hand;

(b) angle detecting means for detecting a swing angle of player's arm to thereby generate an angle signal corresponding to detected swing angle; and (c) musical tone control means for outputting musical tone control data based on the detection signal and the angle signal, the musical tone control data controlling a musical tone generating apparatus, the musical tone generating apparatus being externally provided in order to generate a musical tone which is controlled in response to the depressing pressure of corresponding finger and the swing angle of player's arm.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
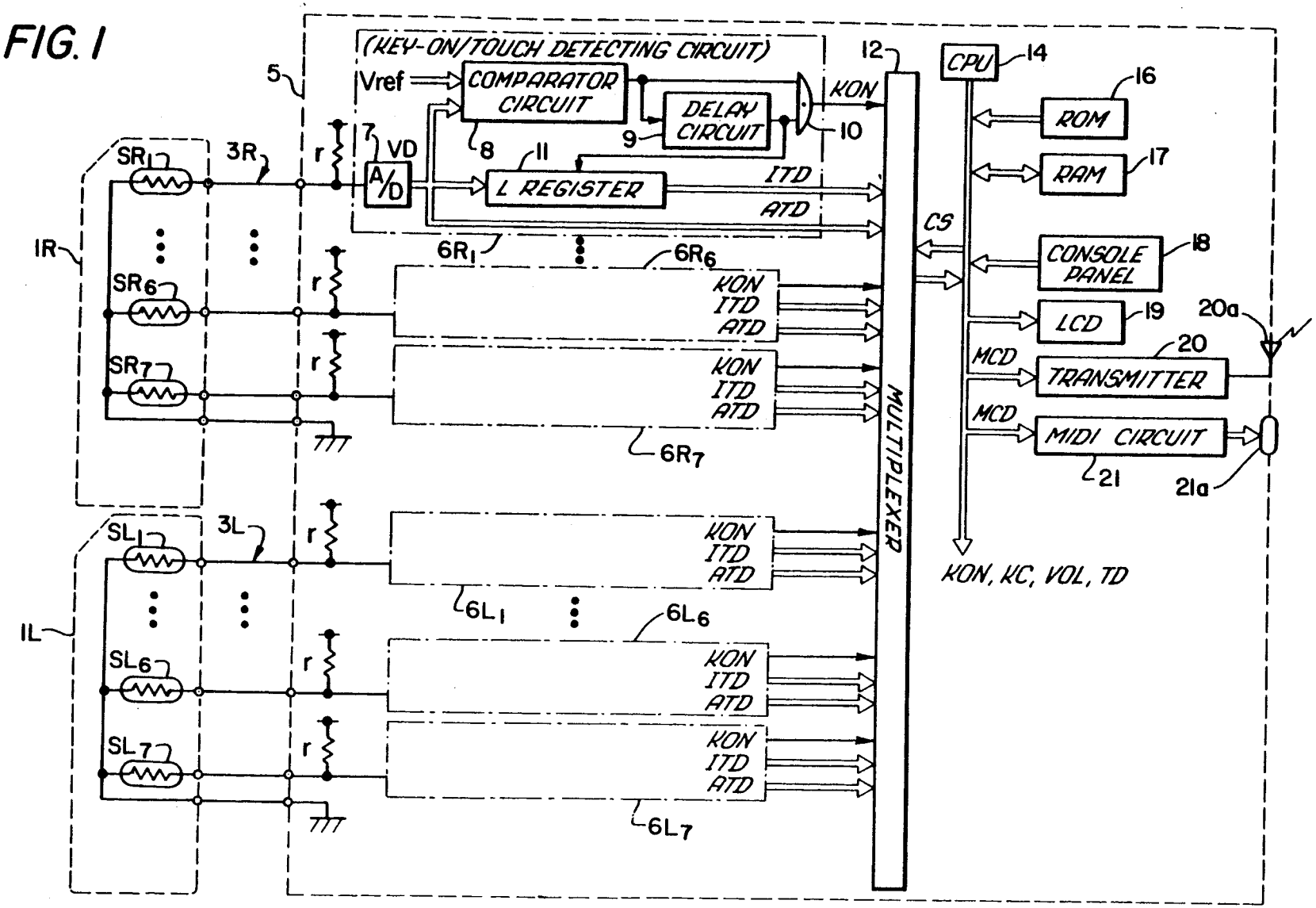
FIG. 1 is a block diagram showing a whole constitution of a musical tone control apparatus according to a first embodiment of the present invention.

Now, description will be given with respect to the preferred embodiments of the present invention in conjunction with the drawings, wherein like reference characters designate like or corresponding parts throughout the several views.

[A] FIRST EMBODIMENT

Figure 2:
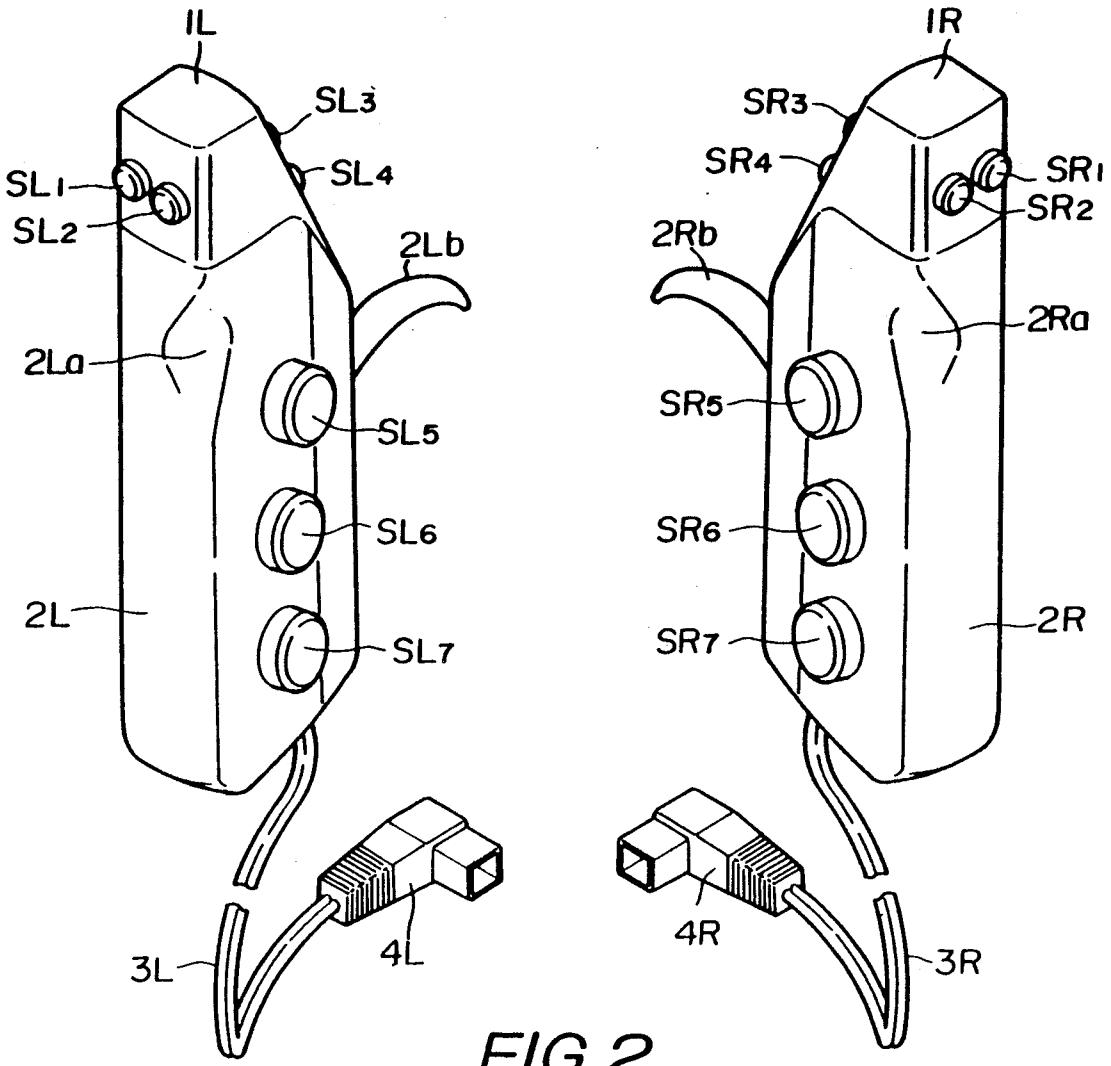
FIG. 2 is a perspective side view showing appearances of right and left grip devices used in the first embodiment.
Figure 3:
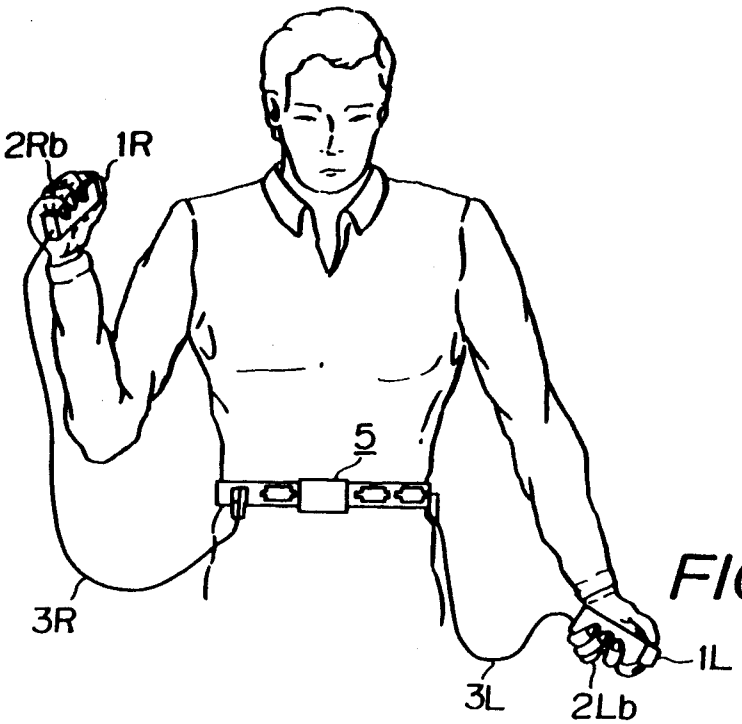
FIG. 3 is a front view showing an appearance of a player who mounts the first embodiment.

FIG. 1 is a block diagram showing the whole constitution of a musical tone control apparatus according to the first embodiment of the present invention. FIG. 2 is a view showing appearances of grip devices IR and IL for a player's right and left hands, and FIG. 3 is a front view showing the appearance of a player who mounts the musical tone control apparatus according to the first embodiment.

First, description will be given with respect to the constitutions of the grip devices 1R and 1L for a player's right and left hands in conjunction with FIG. 2. These grip devices 1R and 1L are constituted symmetrically. Hence, description of the left grip device 1L will be omitted, and description will be given with respect to the right grip device 1R only. The left grip device 1L is constituted by the parts corresponding to those of the right grip 1R, wherein these parts are labeled with the letter "L" instead of the letter "R".

In the right grip device 1R, 2R designates a case having the shape which can be held by the right hand. In other words, in order to fit the holding case 2R with the right hand, a curved face 2Ra which can be in close contact with the root portion between the thumb and index finger of right hand and another stopping portion 2Rb which is held between the third finger and middle finger of right hand are respectively formed at the holding case 2R (see FIG. 3). In addition, the holding case 2R has seven pressure sensors SR1 to SR7 each of which is constituted by a push button and piezoelectric element. This piezoelectric element has resistance which is varied in response to depressing pressure of the push button.

Next, description will be given with respect to the arrangement of these pressure sensors SR1 to SR7. Each of these pressure sensors SR1 to SR7 is arranged at a predetermined position such that each pressure sensor can be easily depressed by each of five fingers when the grip device 1R is held by the right hand. More specifically, the pressure sensors SR1 and SR2 are arranged laterally such that these pressure sensors SR1 and SR2 can be depressed by the thumb, the pressure sensors SR3 and SR4 are arranged vertically such that these pressure sensors SR3 and SR4 can be depressed by the index finger, and the pressure sensors SR5 to SR7 are arranged vertically such that these pressure sensors SR5 to SR7 can be respectively depressed by the middle finger, third finger and little finger. Because of such arrangement, these pressure sensors SR1 to SR7 can be smoothly depressed by five fingers of right hand without effort.

Figure 4:
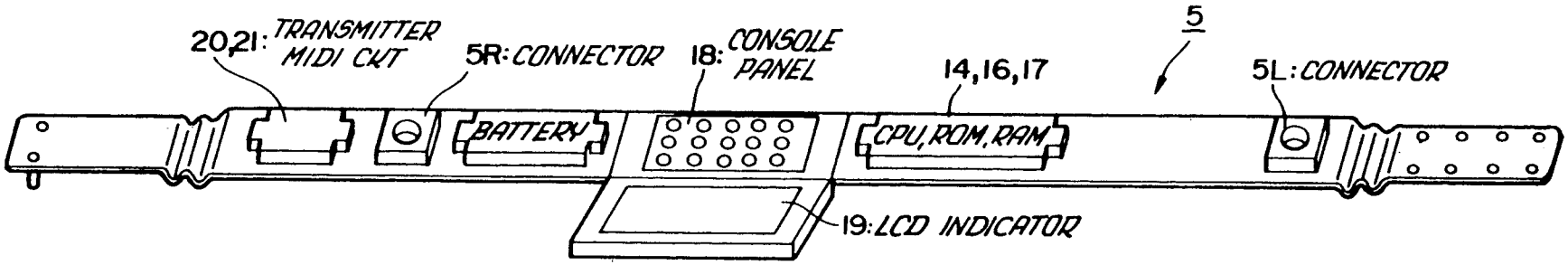
FIG. 4 is a perspective side view showing a belt type main unit used in the first embodiment.

When each pressure sensor is depressed by a corresponding finger tip, the depressing pressure acts on the corresponding piezoelectric element whose resistance is varied. These pressure sensors SR1 to SR7 are connected to a belt type main unit (i.e., musical tone control data generating means) 5 via a cable 3R and connector 4R. As shown in FIG. 3, this main unit 5 is mounted to the player's waist. FIG. 4 shows an appearance of this belt type main unit 5.

Next, in FIG. 1, one terminal of each of the pressure sensors SR1 to SR7 is connected in common to the main unit 5 via the cable 3R and then grounded On the other hand, other terminals of these pressure sensors SR1 to SR7 are connected to the main unit 5 via the cable 3R and then pulled up respectively by pull-up resistors r. In addition, these other terminals are respectively connected to key-on/touch detecting circuits 6R1 to 6R7.

Each of these key-on/touch detecting circuits 6R1 to 6R7 outputs key-on signal KON, initial touch-data ITD and after-touch data ATD based on the detection voltage supplied from each of the pressure sensors SR1 to SR7. The key-on signal KON is outputted when the depressing pressure applied to each pressure sensor becomes larger than the predetermined pressure. In addition, the initial-touch data ITD are the data whose value corresponds to the varying speed of initial touch, i.e., the varying speed of depressing pressure at the instant when each pressure sensor is depressed. Further, the after-touch data ATD are the data whose value corresponds to the continuous variation of depressing pressure while each finger starts and then stops to depress each pressure sensor.

Each of these key-on/touch detecting circuits 6R1 to 6R7 has the same constitution, hence, description will be given with respect to the constitution of key-on/touch detecting circuit 6R1 only.

More specifically, the key-on/touch detecting circuit 6R1 is constituted by an analog-to-digital (A/D) converter 7, comparator circuit 8, delay circuit 9, AND gate 10 and register 11. The A/D converter 7 converts the detection voltage supplied from the pressure sensor SR1 into digital detection voltage data VD of predetermined bits. Such data VD are outputted as the after-touch data ATD. Then, the comparator circuit 8 compares the detection voltage data VD with the reference voltage data Vref. In the case where VD>Vref, the output level of comparator circuit 8 is turned to "H" level. This output signal of comparator circuit 8 is supplied to a first terminal of AND gate 10. In addition, this output signal is delayed by the predetermined time T in the delay circuit 9 and then supplied to a second terminal of AND gate 10. Therefore, when the predetermined time T has passed after VD>Vref, the output level of AND gate 10 turns to "H" level so that such output signal of AND gate 10 having the "H" level is outputted as the key-on signal KON. Meanwhile, the output signal of delay circuit 9 is also supplied to a load terminal L of register 11. When the output level of delay circuit 9 is turned to "H" level, the register 11 latches the detection voltage data VD, and then such latched data are outputted as the initial-touch data ITD.

Next, description will be given with respect to the reason why the data latched by the register 11 are outputted as the initial-touch data ITD when the predetermined time T has passed after VD > Vref in conjunction with FIG. 5.

Figure 5:
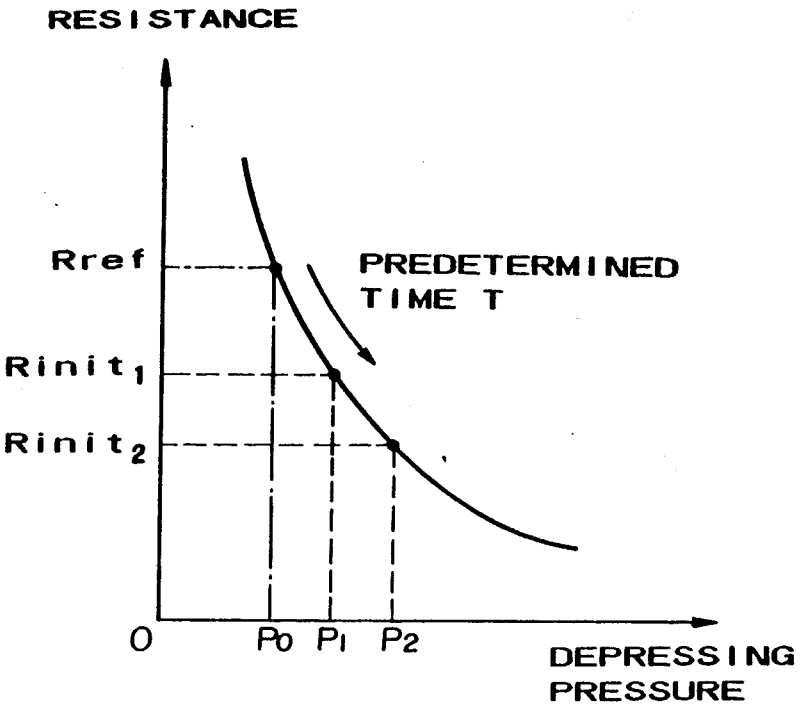
FIG. 5 is a graph showing characteristics of a piezoelectric element used in the first embodiment.

FIG. 5 is a graph showing the relation between the depressing pressure applied to the pressure sensor and its resistance. In FIG. 5, it is supposed that the resistance of the pressure sensor reaches Rref so that the detection voltage VD will be equal to the reference voltage Vref when the depressing pressure reaches P0. Then, in the case where the depressing pressure is applied to the pressure sensor with relatively weak touch (i.e., in the case where the varying speed of depressing pressure is relatively slow), the depressing pressure reaches P1 so that the resistance will be equal to Rinit1 when the predetermined time T is passed away. But, in the case where the depressing pressure is applied to the pressure sensor with relatively strong touch (i.e., in the case where the varying speed of depressing pressure is relatively fast), the depressing pressure reaches P2 (>P1) so that the resistance will be equal to Rinit2 (<Rinit1). As described above, the resistance of pressure sensor when the predetermined time T has, passed after the depressing pressure exceeds P0 depends on the intensity of touch. The resistance will be Rinit2 when the touch is strong, while the resistance will be Rinit1 when the touch is weak. Since the detection voltage data VD outputted from the A/D converter 7 corresponds to the resistance of the piezoelectric element within the pressure sensor, it is possible to obtain the initial-touch data ITD by latching such detection voltage data VD in the register 11.

The above-mentioned key-on/touch detecting circuits 6R1 to 6R7 are respectively provided for the pressure sensors SR1 to SR7. Similarly, key-on/touch detecting circuits 6L1 to 6L7 are provided for the pressure sensors SL1 to SL7 of the left grip device 1L. The key-on signal KON, initial-touch data ITD and after-touch data ATD outputted from each of the key-on/touch detecting circuits 6R1 to 6R7 and 6L1 to 6L7 are supplied to a multiplexer 12.

Based on a channel select signal CS supplied to its select terminal, the multiplexer 12 selects and outputs the key-on signal KON, initial-touch data ITD and after-touch data ATD outputted from one of the key-on/touch detecting circuits 6R1 to 6R7 and 6L1 to 6L7. Meanwhile, 14 designates a central processing unit (CPU), 16 designates a read only memory (ROM) for storing programs used in the CPU 14, and 17 designates a random access memory (RAM) which is used as a work area. The CPU 14 sequentially changes the channel select signal CS to thereby scan the output data of key-on/touch detecting circuits with high speed. Then, the CPU 14 transmits the selected output data to the RAM 17. Based on such selected output data, the CPU 14 generates key code data KC for designating the tone pitch, tone volume data VOL for designating the tone volume and tone color designating data TD for designating the tone color. Incidentally, these key-on signal KON, key code data KC, tone volume data VOL and tone color designating data TD are called musical tone control data MCD.

In addition, 18 designates a console panel including push switches (see FIG. 4) and an encoder which encodes and outputs the outputs of push switches to the CPU 14. Further, 19 designates a liquid crystal display (LCD) indicator (see FIG. 4), and 20 designates a transmitter which modulates the musical tone control data MCD with the carrier wave to thereby output the modulated data from an antenna 20*a* by wireless. A MIDI circuit 21 converts the musical tone control data MCD into the data of MIDI (musical instrument digital interface) standard, and such data of MIDI standard will be outputted to an external device (not shown) via an output terminal 21*a*.

Next, description will be given with respect to the operation of the musical tone control apparatus according to the first embodiment.

In order to perform the music, the player mounts the belt type main unit 5 at his waist as shown in FIG. 3. Then, the connectors 4R and 4L at the tips of cables 3R and 3L which are stretched from the grip device 1R and 1L are respectively connected to connectors 5R and 5L of the main unit 5 (see FIG. 4). Further, in the case where the musical tone generating apparatus is driven by use of wire, the connection cable is connected between the output terminal 21*a* and musical tone generating apparatus. Thereafter, the power is applied to the main unit 5 mounted at the player's waist and the musical tone generating apparatus. Next, the push switches of console panel 18 are operated so that wire-transmission or wireless transmission (i.e., the method for transmitting the data to the musical tone generating apparatus) is designated. In addition, functions are assigned to each pressure sensor of the grip devices 1R and 1L.

In the first embodiment, one of first to fourth octaves is designated based on the outputs of pressure sensors SR1 to SR4 in the right grip device 1R. In addition, based on the combination of the outputs of pressure sensors SR5 to SR7, one of musical scales $C^n$, $D^n$, . . . , $B^n$ and $C^{n+l}$ is designated. In this case, the value "1" corresponds to the key-on and the value "0" corresponds to the key-off in the outputs of pressure sensors SR5 to SR7. Further, based on the outputs of pressure sensors SL1 to SL4 in the left grip device 1L, the key-on and touch intensity are designated. Furthermore, based on the outputs of pressure sensors SL5 to SL7, the tone color is designated.

Next, the player holds the grip devices 1R and 1L by his right and left hands respectively. Then, the player operates the push button in the console panel 18 for commanding the start timing to thereby start the performance. Thereafter, the CPU 14 sequentially transmits the key-on signal KON, initial-touch data ITD and after-touch data ATD to the RAM 17, 18 wherein these data are obtained from one of the key-on/touch detecting circuits 6R1 to 6R7 and 6L1 to 6L7. Based on the transmitted data, the CPU 14 generates the musical tone control data MCD, which are then outputted to the MIDI circuit 21. The MIDI circuit 21 converts the supplied musical tone control data MCD into the data of MIDI standard, which are then outputted to the external musical tone generating apparatus via the output terminal 21*a* and connection cable. Thus, the musical tone generating circuit generates the musical tone from its speaker based on the data of MIDI standard.

Figure 6:
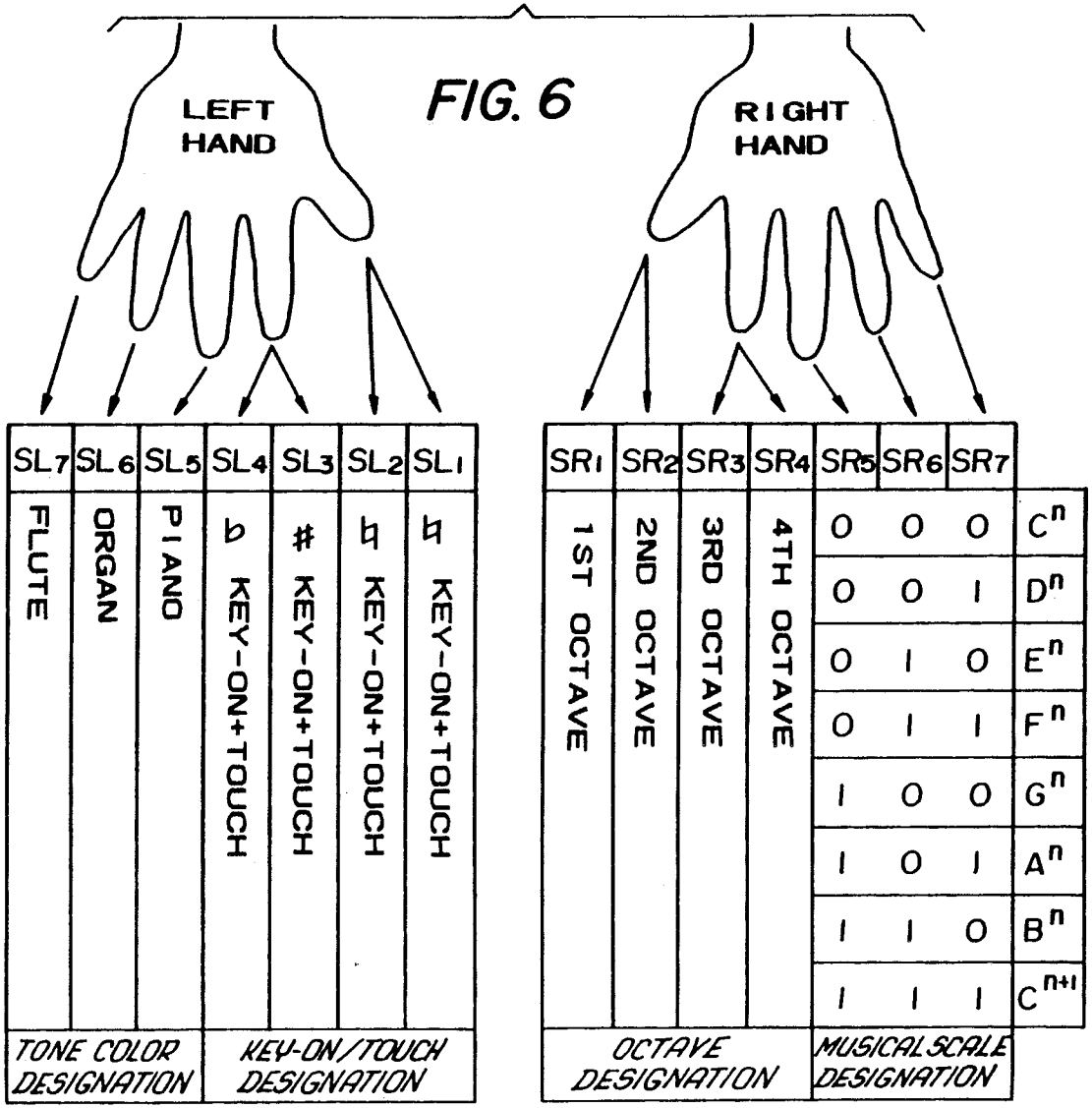

In this case, the functions as shown in FIG. 6 are assigned to the pressure sensors of the grip devices 1R and 1L. For example, the right thumb depresses the pressure sensor SR1 to thereby designate the first octave, the right middle finger depresses the pressure sensor SR5 to thereby designate musical scale $G^n$, and the left little finger depresses the pressure sensor SL7 to thereby designate the flute. In such state, when the left thumb depresses the pressure sensor SL1, the musical tone generating apparatus generates the musical tone having the touch corresponding to its depressing intensity, the tone color of flute and the musical scale $G^1$. Thereafter, when the left index finger depresses the pressure sensor SL3, the musical tone generating apparatus generates the musical tone having the touch corresponding to its depressing intensity and the tone pitch which is higher than the scale $G^1$ by half-tone. On the other hand, when the left index finger depresses the pressure sensor SL4, the musical tone generating apparatus generates the musical tone having the touch corresponding to its depressing intensity and the tone pitch which is lower than the scale $G^1$ by half-tone.

Figure 7:
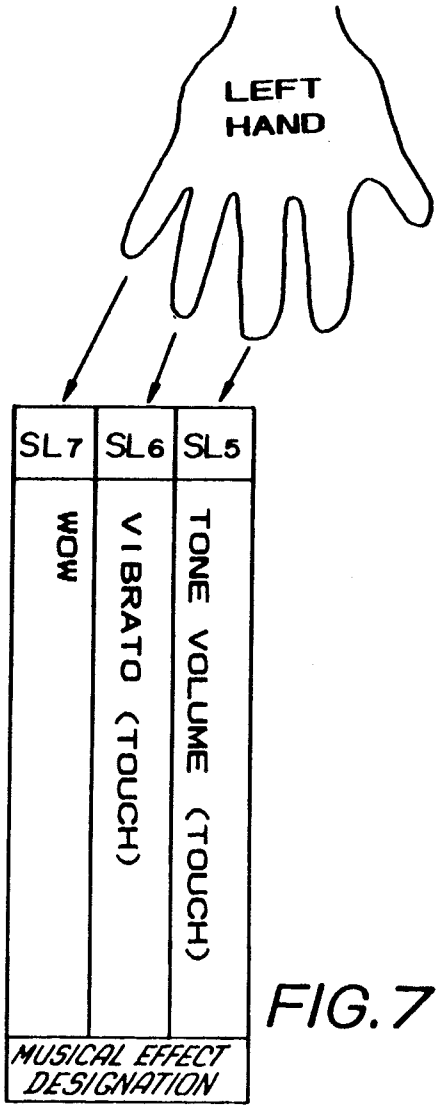
FIGS. 6 and 7 are drawings each showing an example of functions assigned to the pressure sensors.

In the period when the pressure sensors SR1 to SR4 for designating the octave and the pressure sensors SL5 to SL7 for designating the tone color are depressed, the CPU 14 judges the designation of the depressed pressure sensor valid. Incidentally, it is possible to maintain the designations of these pressure sensors SR1 to SR4 and SL5 to SL7. As shown in FIG. 7, it is possible to assign some musical effects such as the tone volume, vibrato and wow based on the outputs of pressure sensors SL5 to SL7 of the left grip device 1L. These musical effects can be arbitrarily set by the player who operates the push switches of the console panel 18.

In the case where "wireless" is selected as the method of transmitting the data to the musical tone generating apparatus, the musical tone control data MCD are supplied to the transmitter 20. Then, the LCD indicator 19 displays the operation contents and the like of the console panel 18.

In the first embodiment described heretofore, the thumb and index finger capable of moving delicately operate two of four pressure sensors SR1 to SR4 (or SL1 to SL4), while the remaining middle finger, third finger and little finger operate one of the pressure sensors SR5 to SR7 (or SL5 to SL7). Hence, the ten fingers can operate the fourteen pressure sensors without effort.

In addition, in the first embodiment, it is possible to detect both of the initial-touch and after-touch based on the output signal of single pressure sensor (i.e., SR1 to SR7 and SL1 to SL7).

Incidentally, it is possible to apply this musical tone control apparatus to the normal electronic keyboard musical instrument such that the initial-touch and after-touch of key can be detected. In addition, it is possible to re-design the first embodiment so that the analog detection voltage of each pressure sensor will be directly used without converting such analog detection voltage into the digital detection voltage data VD in the A/D converter 7.

[B] SECOND EMBODIMENT

Figure 8:
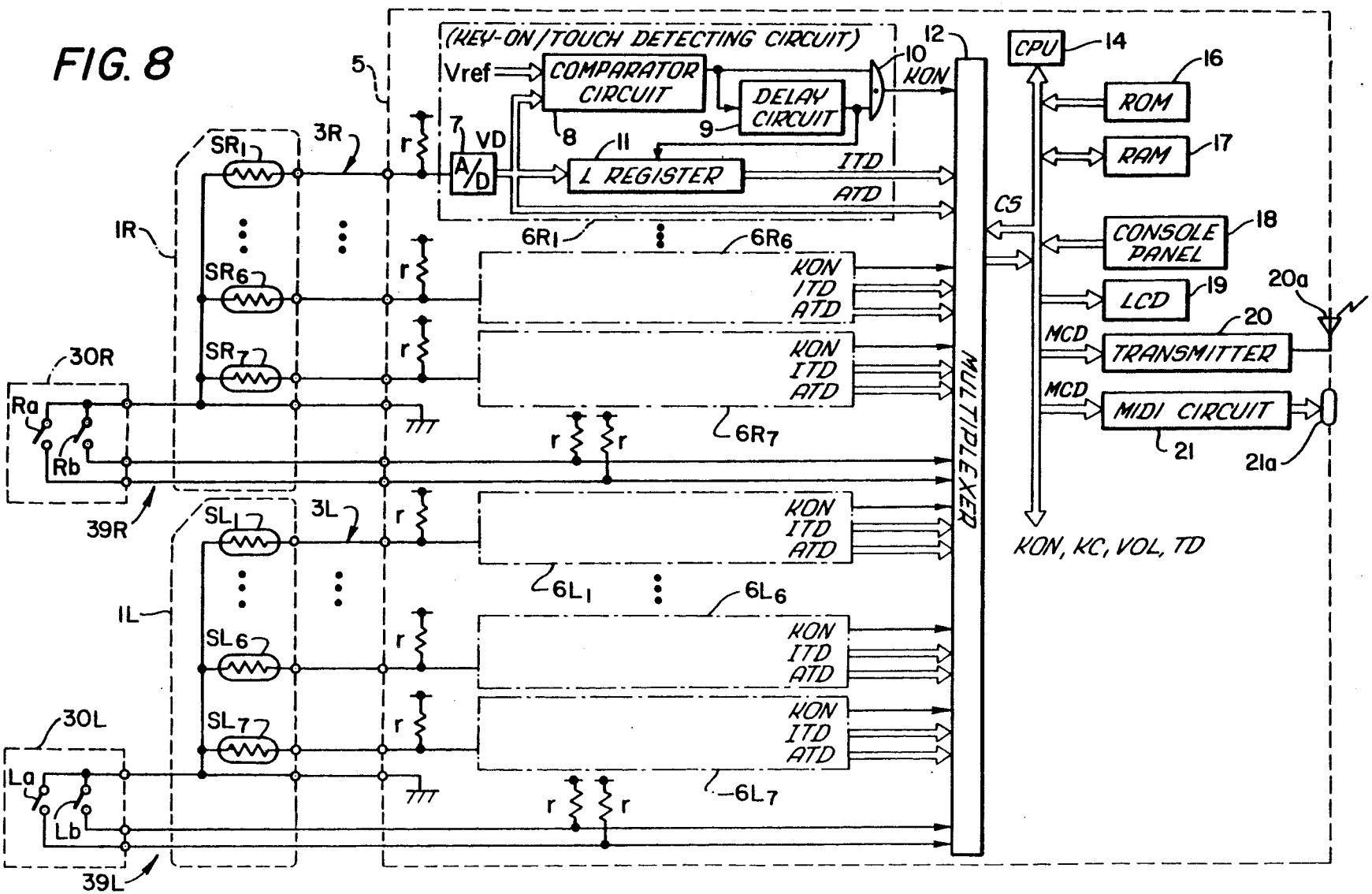
FIG. 8 is a block diagram showing a second embodiment.
Figure 9:
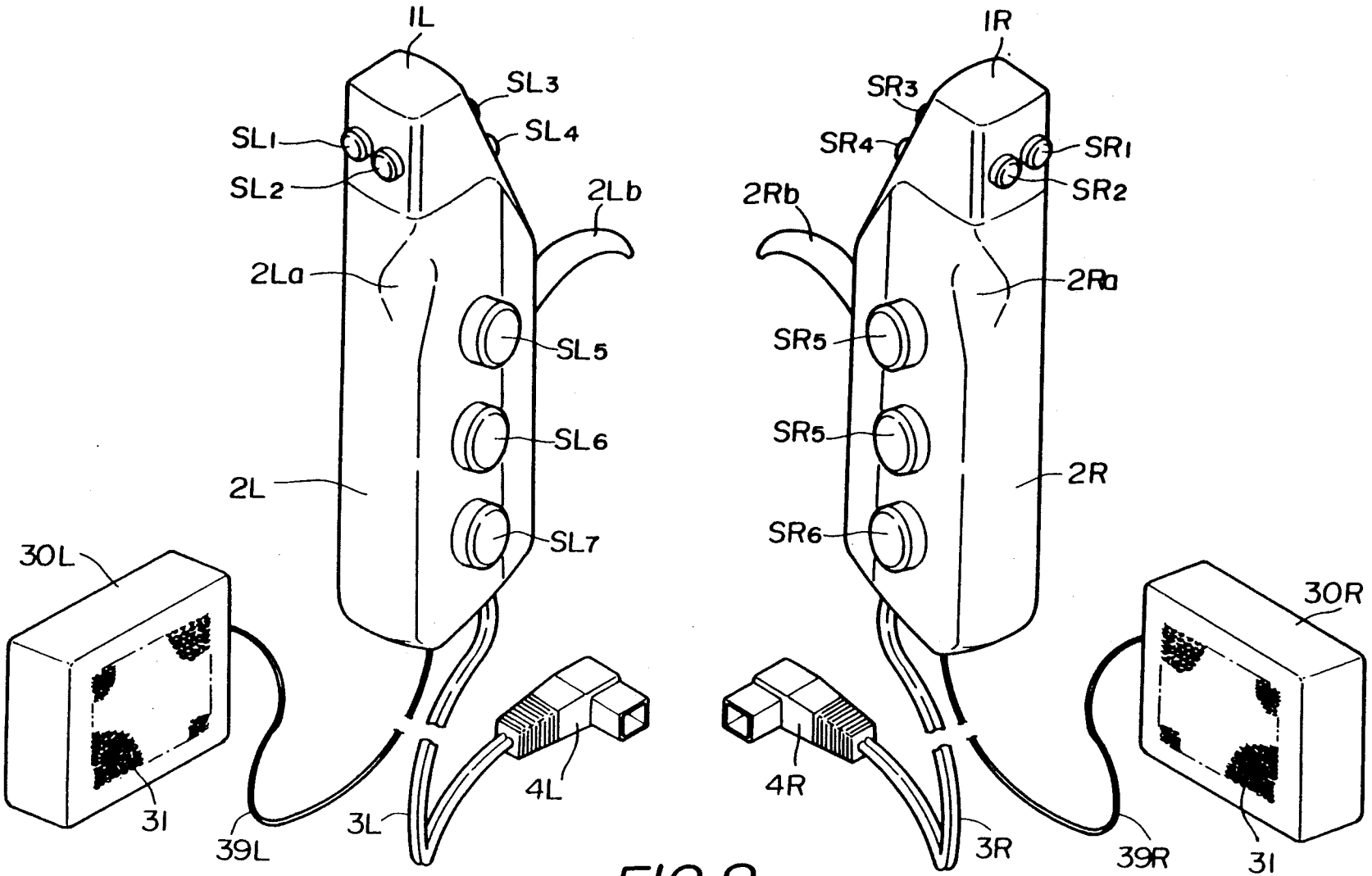
FIG. 9 is a perspective side view showing appearances of grip devices and angle detectors according to the second embodiment.

Next, description will be given with respect to the second embodiment. This second embodiment as shown in FIGS. 8 and 9 is characterized by further comprising angle detectors 30R and 30L for player's right and left arms as compared to the first embodiment shown in FIG. 1. In FIG. 8, parts corresponding to those of first embodiment shown in FIG. 1 are designated by the same numerals, hence, description thereof will be omitted.

In FIG. 8, similar to the grip devices 1R and 1L described before, the angle detectors 30R and 30L are constituted symmetrically. Therefore, hereinafter, description will be given with respect to the right angle detector 30R only, and description of the left angle detector 30L will be omitted.

Figure 10:
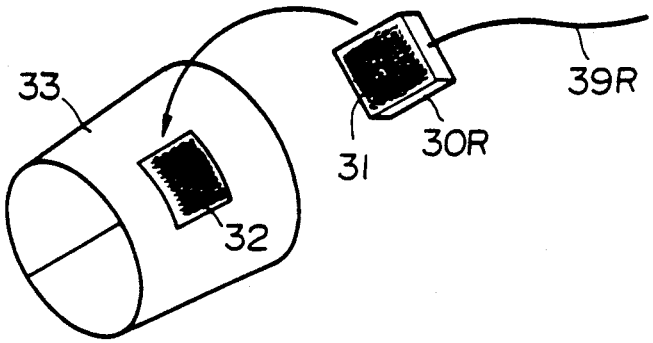
FIG. 10 is a perspective side view showing an example for mounting the angle detector.
Figure 11:
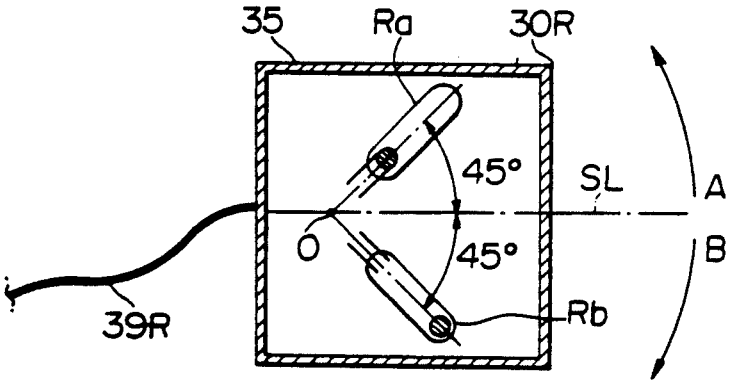
FIG. 11 is a front sectional view showing an inner constitution of the angle detector.
Figure 12:
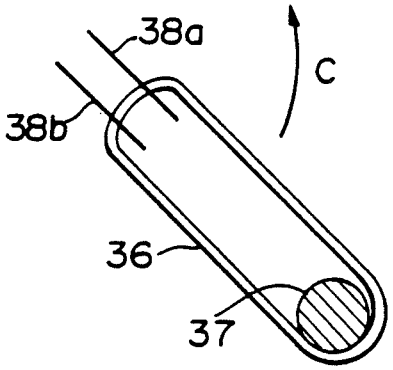
FIG. 12 is a sectional view showing a constitution of a mercury switch used in the angle detector.

As shown in FIG. 10, the angle detector 30R is mounted to a supporter 33 via plane fasteners 31 and 32, and this supporter 33 is mounted to the player's right arm. More specifically, the positive plane fastener 31 is attached to the angle detector 30R, while the negative plane fastener 32 is attached to the supporter 33. Therefore, the angle detector 30R can be freely mounted to and removed from the supporter 33. As shown in FIG. 11, the angle detector 30R is constituted by a case 35 and two mercury switches Ra and Rb. These mercury switches Ra and Rb are arranged such that an angle of 45 degrees is formed between a reference line SL and each of these mercury switches. As shown in FIG. 12, in each mercury switch, mercury liquid 37 is enclosed in a glass tube 36 and one part of each of the electrodes **38*a* and 38*b* is inserted into the inside of this glass tube 36. In the state as, shown in FIG. 12, the electrodes 38*a* and 38*b* are not conducting. However, when the mercury switch is revolved in a direction C, the electrodes 38*a* and 38*b* to conduct due to the mercury liquid 37. Of course, similar to the mercury switches Ra and Rb, the left angle detector 30L** provides mercury switches La and Lb.

In FIG. 11, when the angle detector 30R is revolved around a reference point 0 in a direction A or B, each of the mercury switches Ra and Rb is independently turned on or off. More specifically, in the state where the reference line SL is in parallel with the ground (or earth) as shown in FIG. 11, the mercury switch Ra is turned on but the mercury switch Rb is turned off. Then, when the angle detector 30R is revolved around the reference point 0 in the direction A by more than 45 degrees, both of the mercury switches Ra and Rb are turned on. On the contrary, when the angle detector 30R is revolved in the direction B by more than 45 degrees, both of the mercury switches Ra and Rb are turned off. Such on/off signals of the mercury switches Ra and Rb are guided into the grip device 1R via a cable 39R and then further guided into the main unit 5 via the cable 3R.

In FIG. 8, first terminals of the mercury switches Ra and Rb are connected in common and then guided into the grip device 1R via the cable 39R wherein this common line is further connected to first terminals of the pressure sensors SR1 to SR7 in common and then guided into the main unit 5 via the cable 3R. Then, such common line is grounded in the main unit 5. On the other hand, the second terminals of the pressure sensors SR1 to SR7 are guided into the main unit 5 via the cable 3R and then pulled up by pull-up resistors r. In addition, each of these second terminals are connected to each of the key-on/touch detecting circuits 6R1 to 6R7. Further, second terminals of the mercury switches Ra and Rb are guided into the grip device 1R via the cable 39R. Then, these second terminals are pulled up by the pull-up resistors r and then connected to the multiplexer 12 respectively.

Based on the channel select signal CS, the multiplexer 12 selects one group of the key-on signal KON, initial-touch data ITD and after-touch data ATD outputted from the key-on/touch detecting circuits or the multiplexer 12 selects one of the on/off signals (hereinafter, referred to as angle data) outputted from the mercury switches Ra, Rb, La and Lb. Therefore, the CPU 14 scans the output data of key-on/touch detecting circuits and angle data outputted from the mercury switches with high speed to thereby obtain the key-on signal KON, initial-touch data ITD, after-touch data ATD and angle data, which are then sequentially transmitted to the RAM 17. Based on such transmitted data, the CPU 14 generates the key code data KC, tone volume data VOL, tone color designating data TD and the key-on signal KON, all of which are called the musical tone control data MCD.

Figures 13A, 13B:
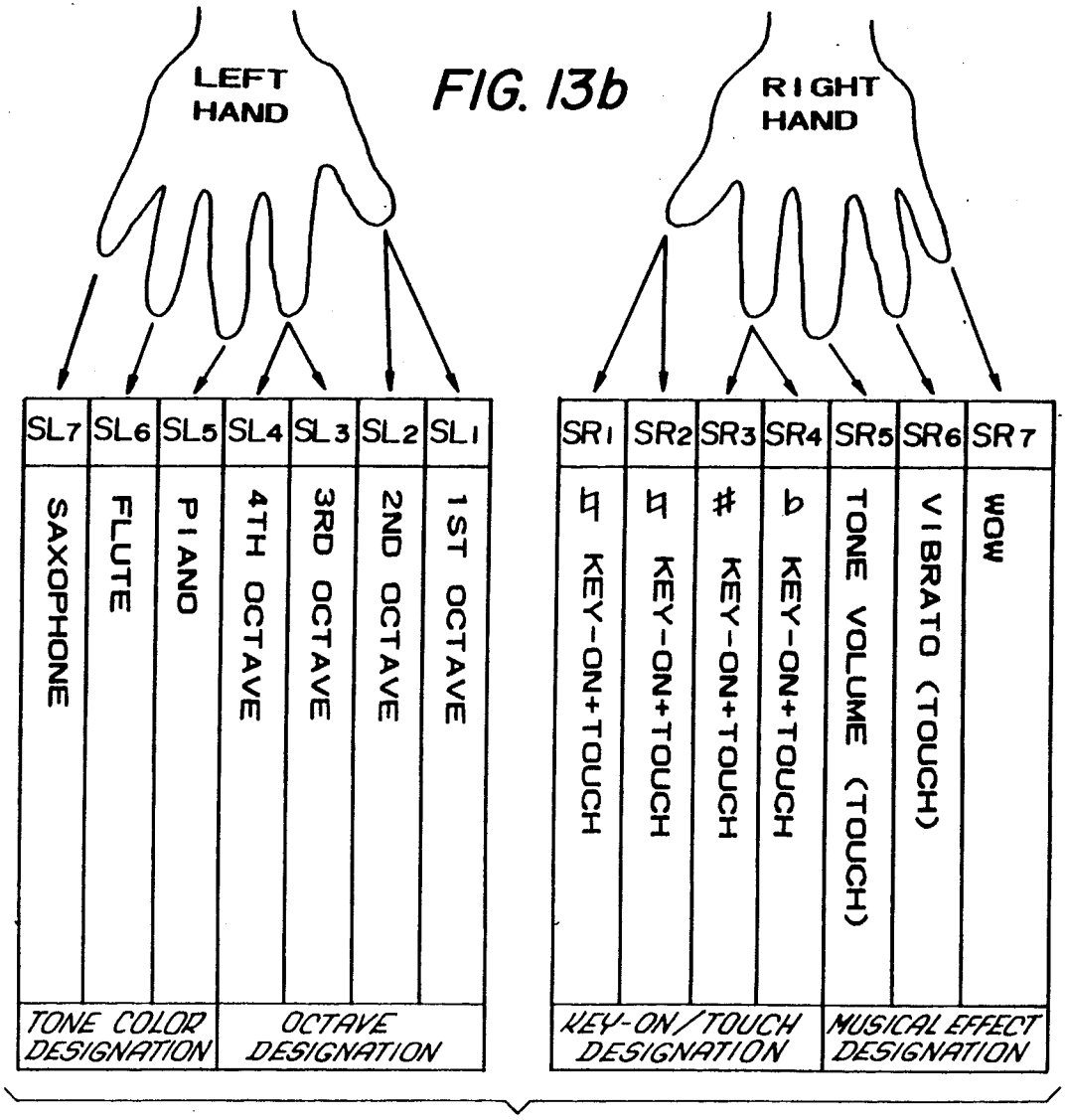
FIG. 13 is a view showing an example of functions assigned to the pressure sensors in the second embodiment.

As shown in FIG. 13, the functions are assigned to each of the pressure sensors in the second embodiment. More specifically, the key-on and touch intensity are designated based on the outputs of pressure sensors SR1 to SR4; the tone volume, vibrato and wow are respectively designated based on the outputs of pressure sensors SR5 to SR7; first to fourth octaves are respectively designated based on the outputs of pressure sensors SL1 to SL4; the tone color is designated based on each of the outputs of pressure sensors SL5 to SL7; and musical scales $C^n$, $D^n$, . . . , $B^n$, $C^{n+1}$, $D^{n+1}$ are designated based on a combination of on/off states of the mercury switches Ra, Rb, La and Lb. Such assignment of functions can be arbitrarily set by operating the push switches of the console panel 18.

In the second embodiment, the player mounts the angle detectors 30R and 30L at his right and left arms respectively by use of the supporter 33, and then the player holds the grip devices 1R and 1L by his right and left hands respectively. Thereafter, the push switch for commanding the start in the console panel 18 is operated so that the performance will be started.

For example, in the state where the player stretches both arms horizontally (so that the mercury switches Ra and La are turned on), the musical scale "$G^n$" is designated; the left thumb depresses the pressure sensor SL1 so that the "first octave" is designated; and the left little finger depresses the pressure sensor SL7 so that the tone color of "saxophone" is designated. In such state, when the right thumb further depresses the pressure sensor SR1, the musical tone generating apparatus generates the musical tone having the touch response corresponding to the depressing intensity of such pressure sensor SR1, the tone color of saxophone and musical scale $G^1$. Next, when the right index finger depresses the pressure sensor SR3, the musical tone generating apparatus generates the musical tone having the touch response corresponding to the depressing intensity thereof and the tone pitch which is higher than the musical scale $G^1$ by half-tone. On the other hand, when the right index finger depresses the pressure sensor SL4, the musical tone generating apparatus generates the musical tone having the touch response corresponding to the depressing intensity thereof and the tone pitch which is lower than the musical scale $G^1$ by half-tone. In addition, when the right middle finger depresses the pressure sensor SR5, the tone volume is varied in response to its depressing intensity. When the right third finger depresses the pressure sensor SR6, the vibrato intensity is varied. Further, when the right little finger depresses the pressure sensor SR7, the wow effect is applied to the musical tone.

Above is the whole description of the preferred embodiments of the present invention. This invention may be practiced or embodied in still other ways without departing from the spirit or essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone control apparatus for providing control data to a musical tone generating apparatus comprising:

(a) detecting means having a shape adapted to be held by one hand of a player, said detecting means outputting a detection signal representing the amount of depressing pressure applied thereto by a finger of the player when said detecting means is held by hand; and (b) musical tone control means for outputting musical tone control data based on said detection signal outputted from said detecting means, said musical tone control data controlling a musical tone generating apparatus, said musical tone generating apparatus being provided externally from the tone control apparatus in order to generate a musical tone which is controlled in response to said depressing pressure.

2. A musical tone control apparatus according to claim 1 wherein said detecting means provides plural pressure sensors each having a piezoelectric element whose resistance is varied in response to said depressing pressure of corresponding finger applied thereto.

3. A musical tone control apparatus according to claim 2 wherein said musical tone control means comprises:

(a) plural detecting circuits each outputting first data based on said depressing pressure of corresponding finger;

(b) selecting means for selecting one of said plural detecting circuits; and (c) means for generating musical tone control data based on said first data of selected detecting circuit.

4. A musical tone control apparatus according to claim 3 wherein said first data include a key-on signal, initial-touch data representing a degree of key depression at the instant when the key is depressed and after-touch data representing a degree of key depression strength when key is continuously depressed, said musical tone control data including at least one of said key-on signal, key code data for designating a tone pitch, tone volume data and tone color designating data.

5. A musical tone control apparatus according to claim 3 wherein said detecting circuit comprises:

(a) converting means for converting detected variation of said depressing pressure of corresponding finger into detection data, said detection data being outputted as after-touch data;

(b) comparator means for comparing value of said detection data with a predetermined value, said comparator means outputting an output signal when the value of said detection data becomes larger than said predetermined value; and (c) means for generating a key-on signal based on the output signal of said comparator means, said means also outputting said detection data corresponding to timing of said key-on signal as initial-touch data.

6. A musical tone control apparatus according to claim 2 wherein one of predetermined musical effects is designated by depressing at least one of said pressure sensors.

7. A musical tone control apparatus comprising:

(a) pressure detecting means for outputting a detection signal having a value corresponding to depressing pressure applied to each key in a keyboard or depressing pressure of each operation button in an apparatus including operation buttons;

(b) timing generating means for generating a timing signal when a predetermined time is passed after the value of said detection signal exceeds a reference value; and (c) storing means for inputting and storing said detection signal at every time when said timing signal is supplied thereto, said storing means outputting its stored data as a first signal corresponding to an initial-touch of each key or operation button, said detection signal being outputted as a second signal corresponding to an after-touch of each key or operation button.

8. A musical tone control apparatus for providing control data to a musical tone generating apparatus comprising:

(a) pressure detecting means having a shape which can be held by one hand of a player, said detecting means outputting a detection signal representing the amount of depressing pressure applied thereto by a finger of the player when said detecting means is held by hand;

(b) angle detecting means for detecting a swing angle of the player's arm to thereby generate an angle signal corresponding to detected swing angle; and (c) musical tone control means for outputting musical tone control data based on said detection signal and said angle signal, said musical tone control data controlling a musical tone generating apparatus, said musical tone generating apparatus being provided externally from the tone control apparatus in order to generate a musical tone which is controlled in response to said depressing pressure of a finger and said swing angle of the player's arm.

9. A musical tone control apparatus according to claim 8 wherein said angle detecting means is attached to a supporter by use of plane fasteners, said supporter being mounted to the player's arm, whereby said angle detecting means is easily mounted to and removed from the player's arm.

10. A musical tone control apparatus according to claim 8 wherein said angle detecting means includes a mercury switch which is turned on or off in response to inclination applied thereto when player mounts said angle detecting means at his arm and then swings his arm up or down.

* * * * *